US010244920B2

(12) United States Patent
Vanini

(10) Patent No.: US 10,244,920 B2
(45) Date of Patent: Apr. 2, 2019

(54) HINGE FOR DOORS OF ELECTRICAL HOUSEHOLD APPLIANCES

(71) Applicant: NUOVA STAR S.p.A., Zola Predosa (Bologna) (IT)

(72) Inventor: Marco Vanini, Bologna (IT)

(73) Assignee: NUOVA STAR S.p.A., Zola Predosa (Bologna) (IT)

( * ) Notice: Subject to any disclaimer, the term of this patent is extended or adjusted under 35 U.S.C. 154(b) by 14 days.

(21) Appl. No.: 15/451,668

(22) Filed: Mar. 7, 2017

(65) Prior Publication Data

US 2017/0260785 A1 Sep. 14, 2017

(30) Foreign Application Priority Data

Mar. 14, 2016 (IT) ..... 102016000026645

(51) Int. Cl.
*A47L 15/42* (2006.01)
*E05F 1/12* (2006.01)
(Continued)

(52) U.S. Cl.
CPC ..... *A47L 15/4261* (2013.01); *A47L 15/4265* (2013.01); *E05D 3/14* (2013.01);
(Continued)

(58) Field of Classification Search
CPC ... A47L 15/4261; A47L 15/4265; E05D 3/14; E05D 3/18; E05D 3/022; E05F 1/1058; E05F 1/1261
See application file for complete search history.

(56) References Cited

U.S. PATENT DOCUMENTS 6,622,345 B2 * 9/2003 Liu ..... E05D 3/022 16/239
8,985,717 B2 * 3/2015 Marzorati ..... E05F 1/1261 16/286

(Continued)

FOREIGN PATENT DOCUMENTS

EP 1894509 B1 3/2010
EP 2407723 A1 1/2012

OTHER PUBLICATIONS

Italian Search Report dated Nov. 16, 2016 from counterpart Italian App No. IT UA20161650.

(Continued)

*Primary Examiner* — Jeffrey O'Brien
(74) *Attorney, Agent, or Firm* — Shuttleworth & Ingersoll, PLC; Timothy Klima

(57) ABSTRACT

A hinge for doors of electric household appliances equipped with a decorative front panel mounted slidably relative to the door in a direction at a right angle to an axis of rotation of the door, including a first element fixable, in use, to the frame of the electrical household appliance and a second element pivoting on the first element through a respective first pin and fixable, in use, to the door, so that the door can be opened and closed by tilting relative to the frame of the electrical household appliance, a tie rod pivoting on the second element and having a respective first cam profile engaging with a guide member integral with the first element, elastic means which are operatively coupled to the tie rod to apply in use a retaining action on the door during the movement of the door from a closed position to an open position.

8 Claims, 6 Drawing Sheets

(51) Int. Cl.

| | |
|---|---|
| ***E05D 3/14*** | (2006.01) |
| ***E05F 1/10*** | (2006.01) |
| ***E05D 3/18*** | (2006.01) |
| *E05D 3/02* | (2006.01) |

(52) U.S. Cl.
CPC ..... *E05D 3/18* (2013.01); *E05F 1/1058* (2013.01); *E05F 1/1261* (2013.01); *E05D 3/022* (2013.01); *E05Y 2900/302* (2013.01); *E05Y 2900/304* (2013.01)

(56) References Cited

U.S. PATENT DOCUMENTS

| | | | | |
|---|---|---|---|---|
| 9,145,722 | B2 * | 9/2015 | Gherardi | E05D 11/08 |
| 2010/0229345 | A1 * | 9/2010 | Donoho | E05F 1/1276 16/374 |
| 2011/0131886 | A1 * | 6/2011 | Durr | A47L 15/4261 49/386 |

OTHER PUBLICATIONS

SMEG, Instruction Manual—Guide for Using the Dishwater and the Washing Programs [Date unknown but prior to U.S. filing date].
IKEA Systems B.V.—Installation Manual—2015.

* cited by examiner

HINGE FOR DOORS OF ELECTRICAL HOUSEHOLD APPLIANCES

This application claims priority to Italian Patent Application No. 102016000026645 filed Mar. 14, 2016, the entirety of which is incorporated by reference herein.

BACKGROUND OF THE INVENTION

This invention relates to a hinge for doors of electrical household appliances.

More specifically, this invention relates to a hinge for doors of recessed electric household appliances equipped with slidable front panels.

In recessed electrical household appliances, that is to say, integrated in modern modular kitchens, it is now typically common practice to provide decorative panels covering the actual doors of the electric household appliances, these panels having the same finish as the rest of the kitchen furniture.

In this way, the overall appearance of the kitchen is overall more uniform, eliminating those discontinuities in appearance which might consist of the parts in view of dishwashers, refrigerators, washing machines and the like.

More specifically, in the case of dishwashers, for which advantageously the hinge according to this invention is intended, doors have been developed containing the control means on the top of the door, so as not to form any obstruction on the front and therefore allow the placing of a decorative front panel which is exactly the same as that of a relative item of containing furniture.

However, a problem has arisen when in the design of the kitchen furniture the height of the lower base has been increasingly reduced, which is located, precisely, under the various elements making up the kitchen.

In order to transmit, basically, an idea of continuity between the floor and the pieces of furniture which rise from this, many designers have in effect designed solutions for kitchens which eliminate or in any case considerably reduce the extension in height of the base of the modular kitchen furniture, so as to transmit, basically, an idea of continuity between the floor and the pieces of furniture which rise from this.

Whilst, on the one hand, eliminating the base has without doubt resulted in benefits in terms of appearance, on the other hand it has created not insignificant difficulties in opening, for example, dishwashers.

Assuming, in effect, a decorative panel fixed to the door of the dishwasher, if, when the machine is closed, it extends substantially as far as the floor (having eliminated the lower base), opening the door would be prevented by the jamming of the panel itself against the floor.

To overcome this drawback, numerous manufacturers have developed slidable coupling systems between the decorative front panel and the door, also forming special kinematic connections which are able to make the decorative panel slide upwards when the door is opened, thus preventing any interference with the floor.

However, whilst the main problem may be said to be in practice resolved, in reality the above-mentioned kinematic coupling and connecting systems have resulted in a greater complexity in the assembly of the panels on the electric household appliances as well as significant additional costs.

In fact, prior art systems have considerable complexities, both in terms of construction and assembly.

SUMMARY OF THE INVENTION

The aim of this invention is to overcome the drawbacks of the prior art by means of a hinge for doors of electric household appliances equipped with slidable front panels which have a simple structure and practical operation.

A further aim of this invention is to provide a hinge for doors of electric household appliances equipped with slidable front panels which is at the same time easily assembled and convertible.

The technical features of the invention according to the above-mentioned objects may be easily inferred from the present disclosure.

BRIEF DESCRIPTION OF DRAWINGS

The advantages of the present invention are more apparent from the detailed description which follows, with reference to the accompanying drawings which illustrate a preferred embodiment of the invention provided merely by way of example without restricting the scope of the inventive concept, and in which.

DESCRIPTION OF PREFERRED EMBODIMENTS

Figure 1:
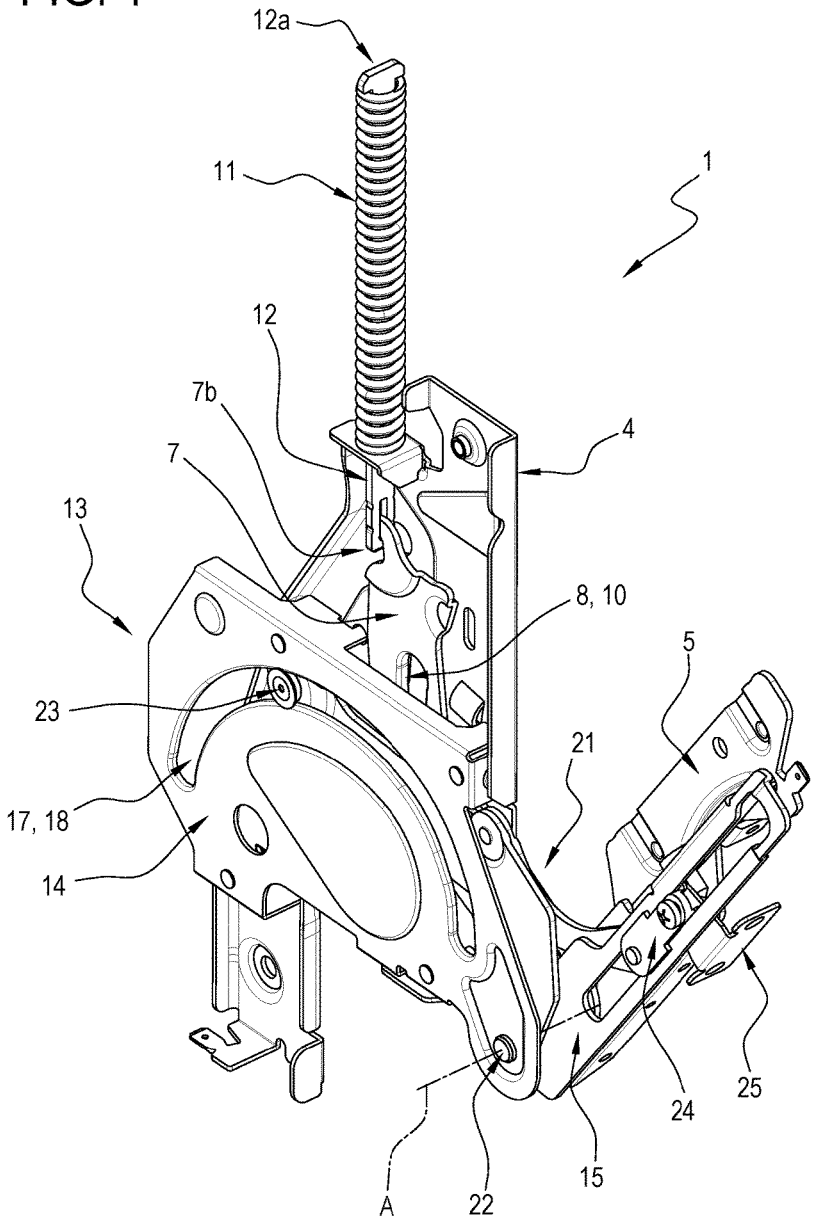
FIG. 1 is a schematic perspective view of an embodiment of the hinge according to this invention in a partly open configuration.
Figure 3:
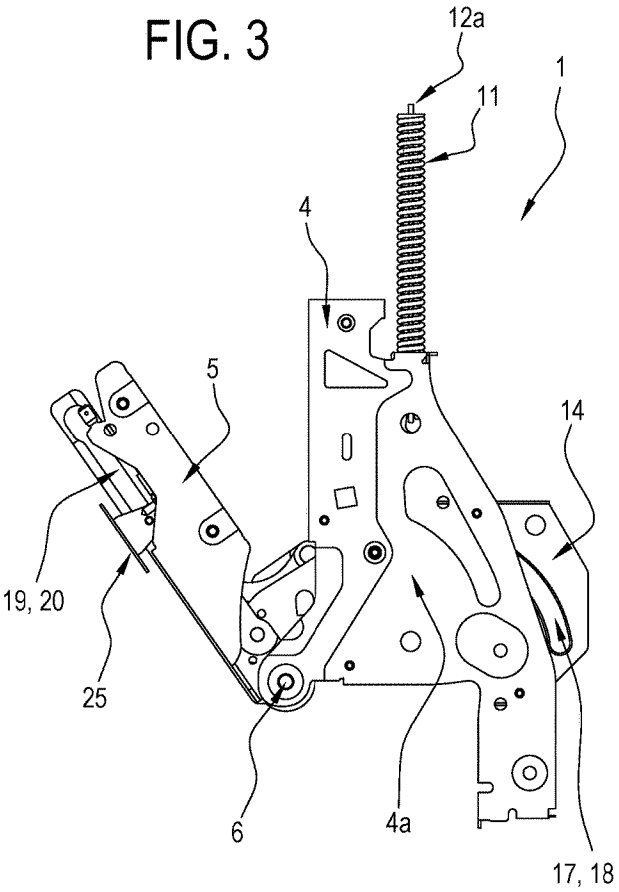
FIGS. 2 and 3 illustrate the hinge of FIG. 1 in respective schematic side elevation views from a different angle.

With reference to the accompanying drawings, the reference numeral 1 denotes in its entirety a hinge made according to this invention.

Figure 2:
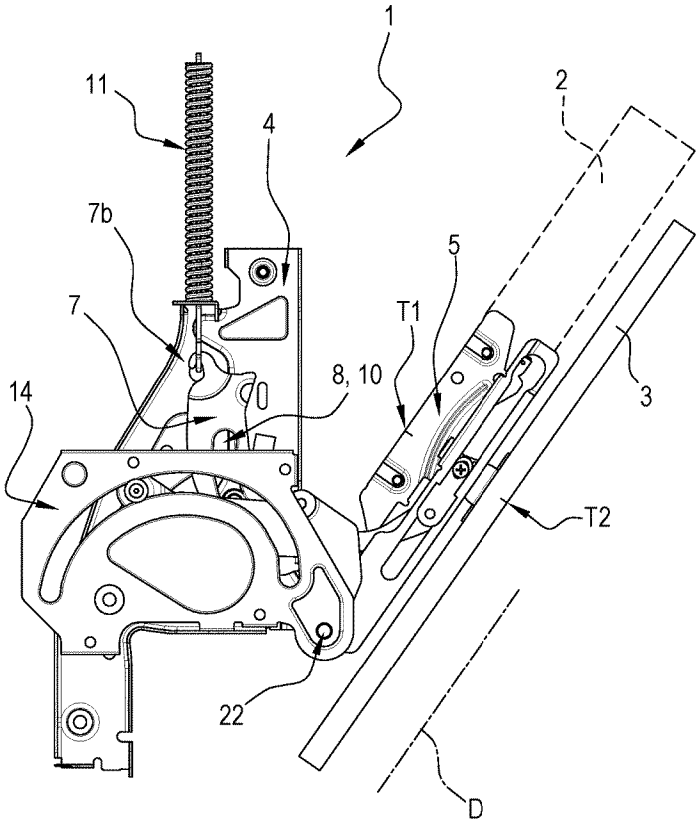
Figure 5:
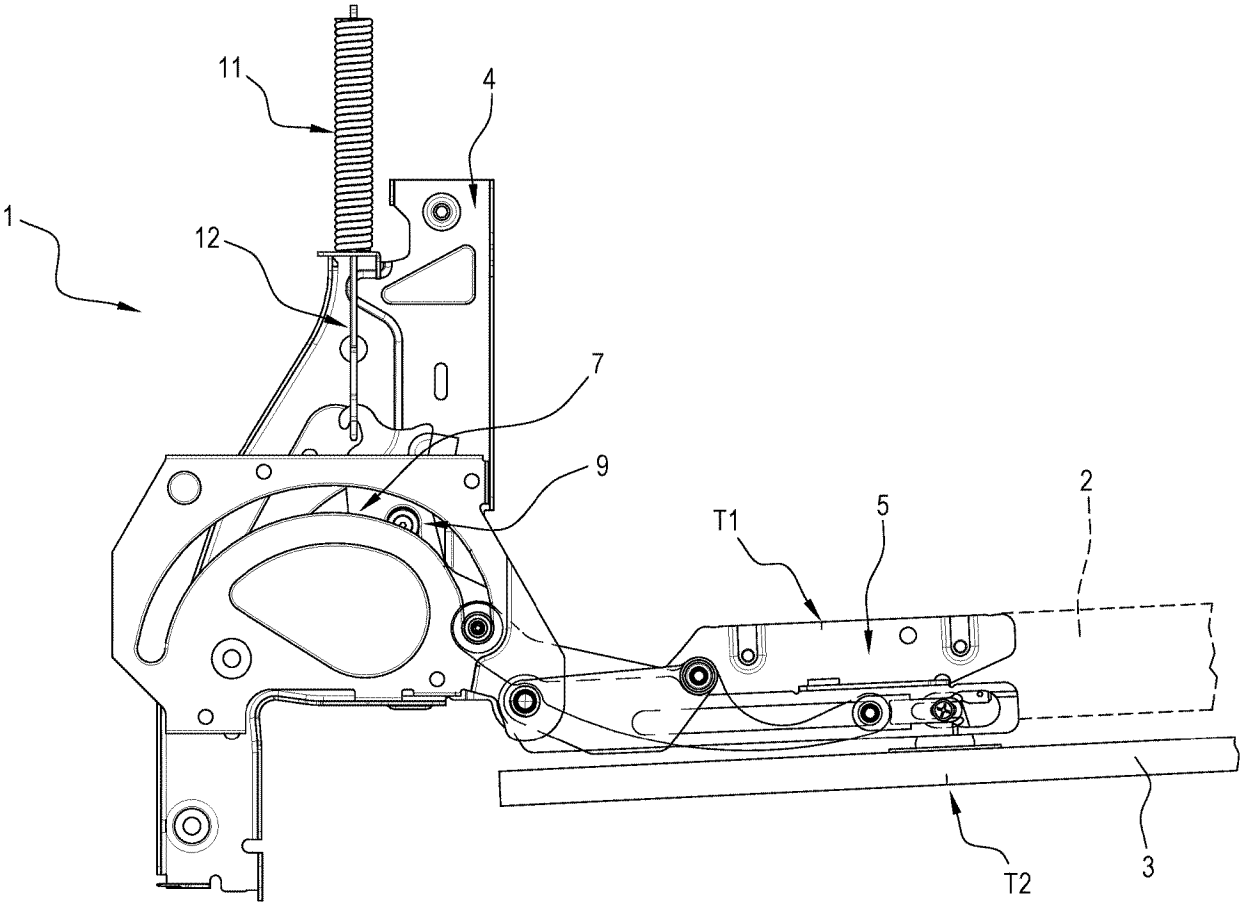
FIG. 5 is a schematic side elevation view, with some parts transparent, of the hinge according to the invention in a fully open configuration.
Figure 6:
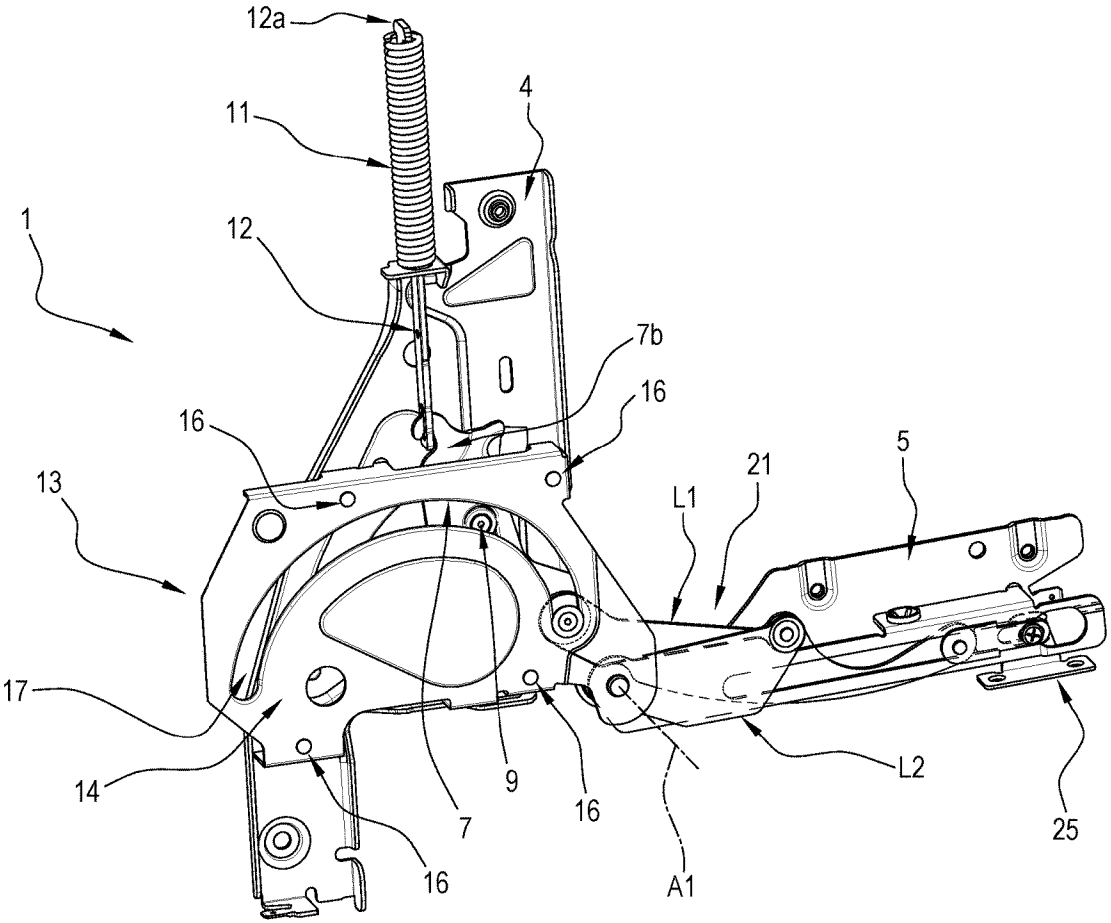
FIG. 6 is a schematic perspective view of the hinge of FIG. 4.
Figure 7:
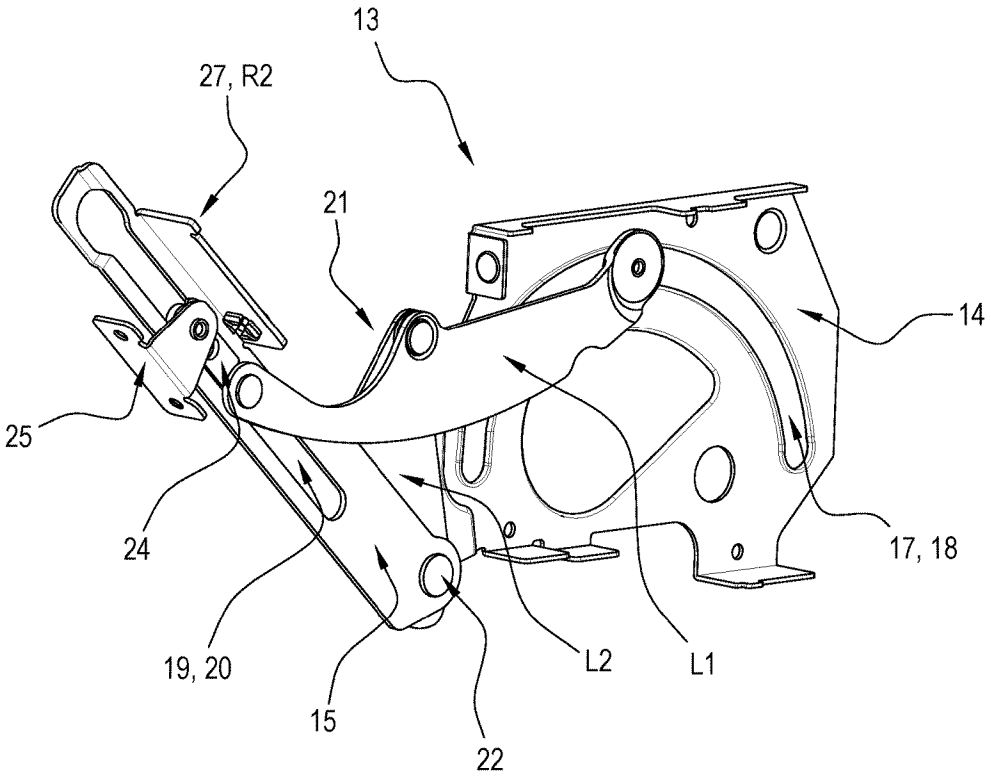
FIG. 7 is a schematic perspective view of a detail of the hinge of FIG. 4, from a different angle.

The hinge 1 according to the invention is designed to be applied to a door 2, illustrated with a dashed line in FIGS. 2 and 5, of an electrical household appliance not illustrated, which can be opened or closed by tilting relative to a frame, also not illustrated, of the electrical household appliance.

Again with reference to FIGS. 2 and 5, a front decorative panel 3 is slidably mounted on the door 2.

The hinge 1 according to the invention comprises a first element 4 and a second element 5.

The first element 4 is fixable, in use, to the frame, not illustrated, of the electrical household appliance whilst the second element 5 is fixable, in use, to the door 2, so as it can be opened and closed by tilting relative to the frame of the electrical household appliance.

The second element 5 is pivoted to the first element 4 by a first pin 6 to allow reciprocal rotation of the elements 4, 5 about a respective axis of rotation A1.

The axis of rotation A1 defines the axis of rotation of the door 2 relative to the above-mentioned, and not illustrated, frame of the electrical household appliance.

The hinge 1 comprises a tie rod 7 pivoting on the second element 5 at its first end 7*a*.

The tie rod 7 has a first cam profile 8, the first profile 8 engaging, during the movement of the tie rod 7, with a respective guide member 9 integral with the first element 4.

The first cam profile 8 is advantageously formed by a respective curved slot 10 formed in the body of the tie rod 7.

The guide member 9 is advantageously defined by a roller or a pin protruding from a substantially flat wall 4*a* of the first element 4 and designed to engage inside the curved slot 10 in order to condition the sliding of the latter.

The hinge 1 also comprises a helical spring 11 and a drive rod 12 of the spring 11, both supported by the first element 4.

The drive rod 12 is hooked below to the tie rod 7 at a relative second end 7*b*, opposite the above-mentioned first end 7*a*.

The drive rod 12 of the spring 11 is advantageously positioned inside the spring 11 and is connected to the top thereof, in such a way as to compress it at the opening of the second element 5.

In other words, the drive rod 12 has an upper end 12*a* that is longitudinally opposite the end that is hooked to the tie rod 7, the upper end 12 being designed to engage an upper end coil of the spring 11 in such a way as to compress the spring 11.

The guide member 9 and the first cam profile 8 are configured in order to condition the action of the spring 11 on the movement of the second element 5.

In other words, during the angular movement of the second element 5 relative to the first element 4, the tie rod 7, thanks to the first cam profile 8, makes it possible to modulate the action of the spring 11 according to a predetermined law.

As illustrated in the accompanying drawings, the hinge 1 comprises a kinematic unit 13 configured to impart to the front decorative panel 3 a movement relative to the door 2 to determine the mutual sliding during the opening of the door 2.

The kinematic unit 13 comprises a first body 14.

The first body 14 is made integral to the first element 4 by respective rivets 16.

The rivets 16, define, for the hinge 1, respective connecting means of the first body 14 to the first element 4.

The first body 14 of the kinematic unit 13 has a second cam profile 17.

The second cam profile 17 is advantageously defined by a respective second slot 18 formed in the first the body 14.

The kinematic unit 13 comprises a second body 15 pivoted on the above-mentioned first body 14.

The second body 15 has a respective longitudinal guide 19 defined by a third slot 20.

The kinematic unit 13 comprises a linkage 21 connecting between the above-mentioned first body 14 and second body 15.

The connecting linkage 21 comprises a first lever L1 and a second lever L2.

The second lever L2 is pivoted with its top end on the above-mentioned first lever L1 and, with its lower end, on a respective second pin 22 defining also the fulcrum of mutual rotation between the above-mentioned first and second body 14 and 15.

The first lever L1 has, at a relative first end, a follower unit 23 designed to engage with the above-mentioned second cam profile 17.

At its second end opposite the above-mentioned first end, the first lever L1 is connected rotatably to a block 24 slidable along the longitudinal guide 19 made on the second body 15.

The block 24 supports a bracket 25 integral with the above-mentioned decorative front panel.

The kinematic unit 13 is configured to determine, following the mutual rotation of the relative first and second bodies 14, 15, a sliding of the block 24 and the bracket 25 connected to it, thereby causing the simultaneous relative sliding between the decorative front panel 3 and the door 2 of the electrical household appliance.

The hinge 1, in a partially assembled configuration wherein the kinematic unit 13 is detached from the rest of the components of the hinge 1. In this configuration, showing an example of the absence of the kinematic unit 13, the hinge 1 operates perfectly and is capable of guaranteeing for the door 2 the same law of motion during the opening, with the only difference that in does not have any means to generate the sliding of a front panel 3 relative to the door 2.

The fact of being able to apply or not apply the kinematic unit 13 to the hinge 1 is allowed by the presence, on the hinge 1, of means 16 for connecting the kinematic unit 13 and that the kinematic unit 13 is kinematically disconnected from the others components of the hinge 1.

Therefore, advantageously, the hinge 1 according to this invention can be easily modified from a hinge designed to be applied to the doors of electrical household appliances equipped with a decorative front panel mounted slidably to a basic or normal hinge and vice versa.

FIGS. 2 and 5 illustrate a succession of steps of opening the door 2, starting from FIG. 2 and concluding in FIG. 5.

As may be clearly inferred from FIGS. 2 and 5, during the opening of the door 2, the tilting movement of the second element 5 relative to the first element 4 of the hinge 1, results in, due to the shape and arrangement of the first and second bodies 14, 15 and the first and second levers L1, L2, the sliding of the decorative front panel 3 relative to the door 2.

In FIG. 2 the reference T1 denotes a notch on the second element 5 integral with the door 2 whilst a corresponding notch T2 is marked on the decorative front panel 3. In FIG. 5, in which the hinge is shown in a relative open configuration, the notches T1, T2 appear spaced by the corresponding measurement of the relative sliding between the door 2 and the decorative panel 3.

During the opening of the door 2, the first lever L1, using the block 24 which is rendered integral by the bracket 25 to the panel 3, imparts to the latter a movement in a direction D at right angles to the axis A1, in the direction indicated by the arrow S which, thanks to sliding means not illustrated, generates a relative movement between the panel 3 and the door 2.

Advantageously, the fact that the movement of the lever L1 (which transfers by means of the block 24 the sliding movement to the front panel 3) is controlled by the second cam profile 17 allows, by varying the latter, the law of motion of the panel 3 to be varied relative to the door 2.

In other words, the hinge according to the invention allows the variation of the law of sliding of the front panel 3 as a function of the specific requirements, by simply modifying the shape of the second cam profile 17, also keeping unchanged the other parts of the kinematic unit 13.

The hinge 1 according to the invention achieves the preset aims and brings important advantages.

The fact that the parts of the hinge 1 acting on the decorative panel 3, that is to say, the kinematic unit 13, are basically separate from those involved in the tilting movement of the door 2, that is to say, the tie rod 7 and the second element 5, allows the forces acting on the kinematic unit 13 to be significantly limited which, in practice, is almost completely unloaded, relative to the resultant acting on the hinge 1, of the elastic forces (of the spring 11) and weight (of the door 2 and decorative panel 3).

Advantageously, the second body 15 of the kinematic unit 13 and the second element 5 have respective contact portions R1, R2 useful for the purposes of correctly assembling the hinge 1.

More in detail, on the second element 5 there is a hole 26 (defining the portion R1) whilst on the second body 15 there is a tab 27 (defining the portion R2) protruding in the direction of the second element 5 and designed to be inserted at least partially in the above-mentioned hole 26.

Thanks to the above mentioned contact portions R1, R2, the assembly of the hinge 1 appears facilitated, as the perfect mutual positioning of the second body 15 and the second element 5 is guaranteed.

In other words, the assembly of the kinematic unit 13 on the base hinge can even be performed after the base hinge has already been mounted on the electrical household appliance. In effect, the first body 14 is easily connectable to the first element 4 using a plurality of rivets 16.

As illustrated in the accompanying drawings, the first element 4 has a substantially flat wall 4*a* and the movable components of the hinge 1 are all located at an inner face of the substantially flat wall 4*a*.

Advantageously, in this way, when the kinematic unit 13 is installed, the hinge 1 is protected and enclosed, in the relative part integrated in the frame of the electrical household appliance, between the above-mentioned substantially flat wall 4*a* of the first element 4 and a substantially flat wall 14*a* of the first body 14.

Also, the hinge according to the invention is compact and equipped with a limited number of components with respect to its evolved functionality.

Figure 4:
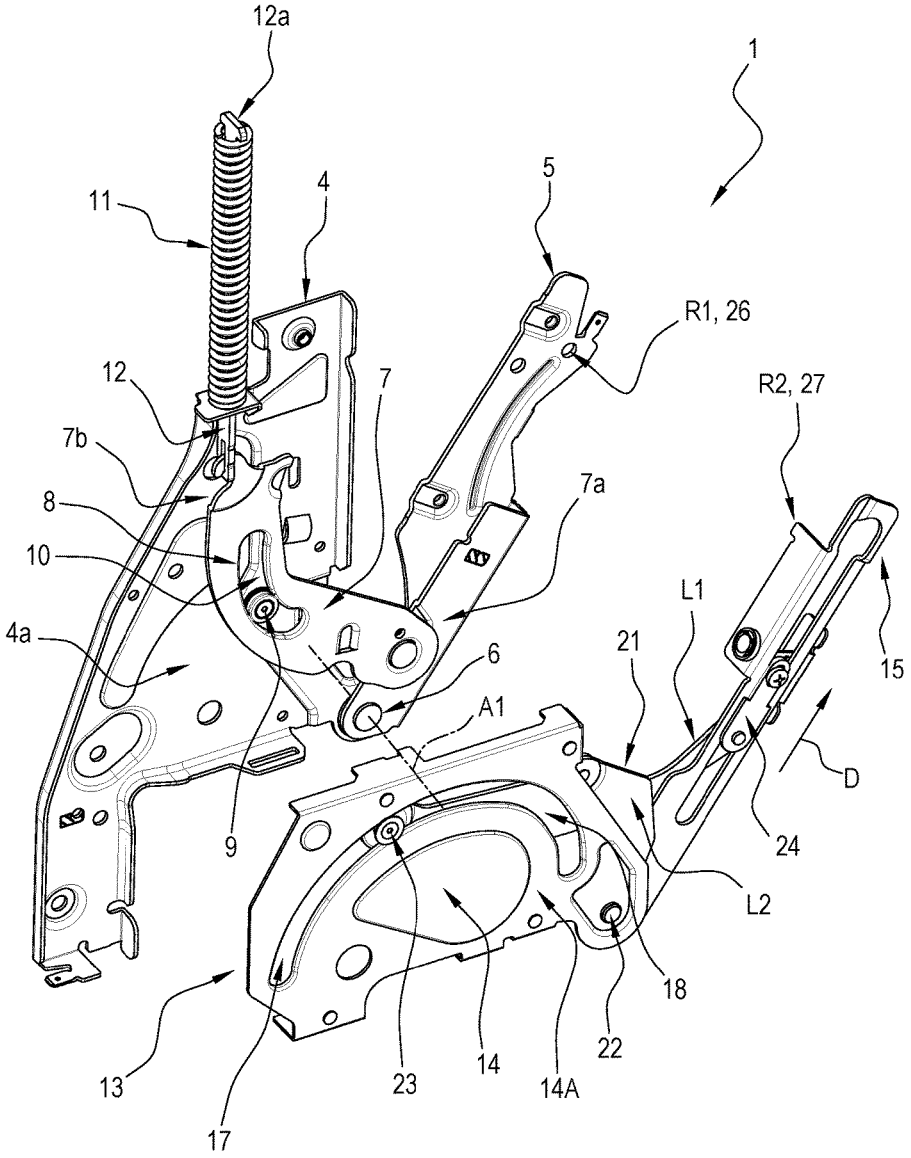
FIG. 4 is a schematic perspective view of a detail of the hinge of the previous drawings in a partly disassembled condition.

Another advantage linked to the use of the hinge according to this invention is due to the fact that the block 24 for connecting to the panel, as clearly shown in FIG. 4, is disengaged from the second element 5 and, therefore, can be easily fixed to the decorative panel 3 at any time. Even after the connection of the door 2.

This opportunity also allows the assembly and adjustment of the door 2 to the frame to be performed during assembly of the electrical household appliance and only subsequently slidably connecting the panel 3 to the door 2 and to the block 24 when the installation of the decorative panel 3 is actually requested.

What is claimed:

1. A hinge for a door of an electrical household applicance provided with a decorative front panel slidably mounted relative to the door along a direction which is orthogonal to an axis of rotation of the door, the hinge comprising, a first element which is fixable, in use, to a frame of the electrical household appliance, the first element including a guide member which is integral with the first element, a first pin, a second element pivoted on the first element via the first pin and which is fixable, in use, to the door so that the door can be opened or closed by tilting relative to the frame of the electrical household appliance, a tie rod pivoted on the second element and including a first cam profile, the first cam profile engaging with the guide member, an elastic member operatively coupled to the tie rod for applying, in use, a retaining action on the door during movement of the door from a closed position to an open position, a kinematic unit configured to impart, to the decorative front panel, a movement relative to the door to determine mutual sliding between the door and the decorative front panel, wherein the kinematic unit comprises a first body which is connected to the first element, a second body pivoted on the first body and having a longitudinal guide, and a connecting linkage between the first body and the second body, the connecting linkage controlling movement of a bracket which is connectable with the decorative front panel, the bracket being slidable along the longitudinal guide;

a second pin defining a fulcrum of the first body and the second body;

wherein the connecting linkage comprises a first lever and a second lever, the first lever having a first longitudinal end and a second longitudinal end opposite the first longitudinal end, the second lever being pivoted on the first lever and on the second pin;

wherein the first body includes a second cam profile and the first lever includes a follower member for engaging the second cam profile;

wherein the follower member is positioned at the first longitudinal end and the first lever is connected to the bracket at the second longitudinal end.

2. The hinge according to claim 1, wherein the first lever, second lever and tie rod are enclosed between a flat wall of the first body and a flat wall of the first element.

3. The hinge according to claim 1, wherein the first pin and the second pin are positioned coaxial to each other.

4. The hinge according to claim 1, wherein the longitudinal guide is defined by a slot made in the second body.

5. The hinge according to claim 4, and further comprising a block which is slidably engaged in the slot, the bracket being connected to and supported by the block.

6. The hinge according to claim 1, and further comprising fasteners permanently connecting the first body to the first element.

7. The hinge according to claim 1, and further comprising rivets connecting the first body to the first element.

8. The hinge according to claim 1, wherein the elastic member is a helical spring.

* * * * *